US008122640B2

(12) United States Patent
Chou

(10) Patent No.: US 8,122,640 B2
(45) Date of Patent: Feb. 28, 2012

(54) VASE WITH ROTATABLE INNER CONTAINER

(76) Inventor: Yung-Ming Chou, Hualien (TW)

( * ) Notice: Subject to any disclaimer, the term of this patent is extended or adjusted under 35 U.S.C. 154(b) by 567 days.

(21) Appl. No.: 12/344,226

(22) Filed: Dec. 25, 2008

(65) Prior Publication Data

US 2010/0012661 A1 Jan. 21, 2010

(30) Foreign Application Priority Data

Jul. 21, 2008 (TW) ..... 97212941 U

(51) Int. Cl.

| | |
|---|---|
| ***B65D 85/50*** | (2006.01) |
| ***B65D 21/02*** | (2006.01) |
| ***B65D 25/00*** | (2006.01) |
| ***A47G 19/00*** | (2006.01) |
| ***A01G 5/00*** | (2006.01) |
| ***A01G 31/00*** | (2006.01) |
| ***A01G 9/02*** | (2006.01) |

(52) U.S. Cl. ..... 47/41.01; 220/23.91; 220/23.83; 220/23.87; 220/23.89; 220/737; 47/66.1; 47/66.5

(58) Field of Classification Search ..... 220/23.83, 220/23.87, 23.89, 23.91, 737; 206/423, 457; 47/41.01, 66.1, 66.5; 40/473, 493, 484, 456, 40/430

See application file for complete search history.

(56) References Cited

U.S. PATENT DOCUMENTS 5,054,624 A * 10/1991 Camp ..... 211/85.2

* cited by examiner

*Primary Examiner* — Mickey Yu
*Assistant Examiner* — Kareen Rush

(57) ABSTRACT

A vase in one embodiment includes an outer shell comprising open top and bottom ends and at least one opening on the surface; a base comprising a projecting member on the top with the bottom end of the outer shell being securely put thereon, an annular flange on the top of the projecting member, and an annular bearing releasably fastened in the flange; and an inner container disposed in the outer shell and comprising an upper member projecting out of the top end of the outer shell, a central shaft projecting downward from the underside to be rotatably disposed in the bearing, and at least one pattern on the outer surface. The inner container is adapted to rotate about the outer shell by rotating the upper member.

12 Claims, 7 Drawing Sheets

VASE WITH ROTATABLE INNER CONTAINER

BACKGROUND OF THE INVENTION

1. Field of Invention

The invention relates to vases and more particularly to an amusement oriented vase having a stationary outer shell and an inner container adapted to rotate about the outer shell so that, for example, a pattern on the outer surface of the inner container can be rotatably seen through an opening of the outer shell by rotating the inner container.

2. Description of Related Art

One conventional type of vase has a specially designed pattern formed on its outer surface. However, such vases may be dull since they are stationary.

There have been numerous suggestions in prior patents for vase. For example, U.S. Pat. No. 6,907,692 discloses a spinning vase device and method. Thus, continuing improvements in the exploitation of vase are constantly being sought.

SUMMARY OF THE INVENTION

It is therefore one object of the invention to provide an amusement oriented vase having a stationary outer shell and an inner container adapted to rotate about the outer shell so that, for example, a pattern on the outer surface of the inner container can be rotatably seen through an opening of the outer shell by rotating the inner container.

It is another object of the invention to provide an amusement oriented vase having a stationary, transparent outer shell and an inner container adapted to rotate about the outer shell so that, for example, a pattern on the outer surface of the inner container can be seen by rotating the inner container or not.

The above and other objects, features and advantages of the invention will become apparent from the following detailed description taken with the accompanying drawings.

DETAILED DESCRIPTION OF THE INVENTION

Figure 1:
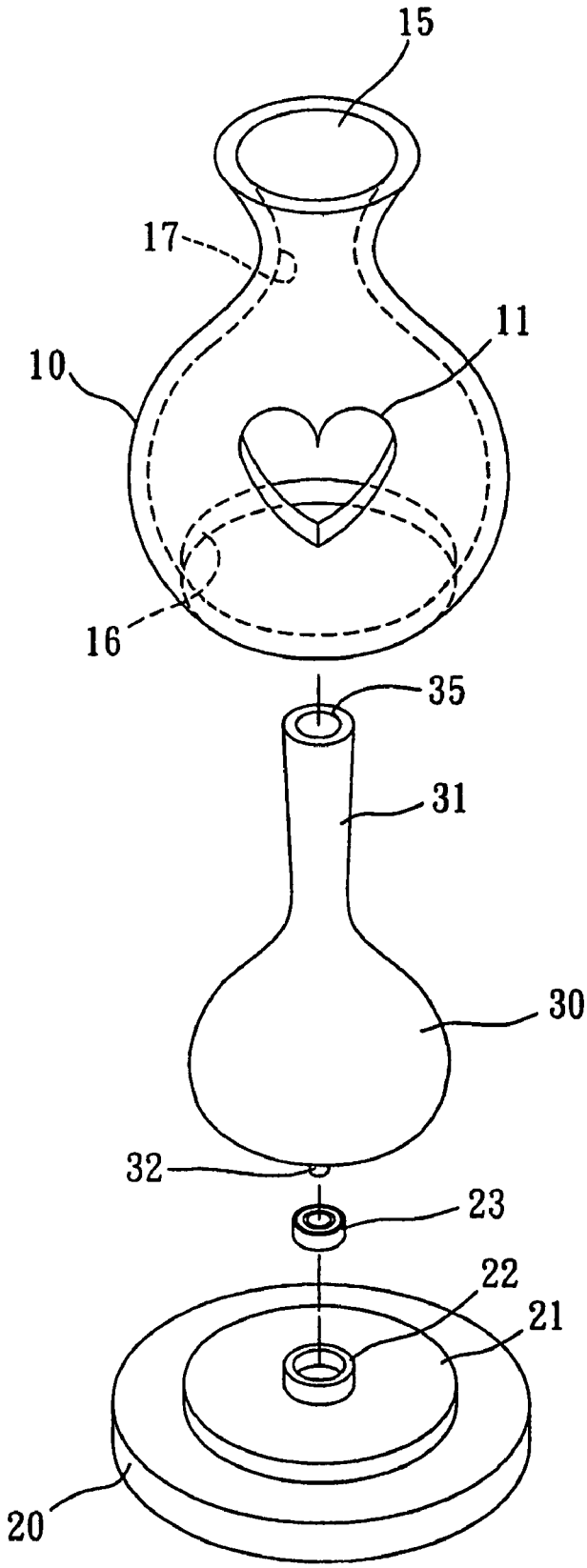
FIG. 1 is an exploded view of a first preferred embodiment of vase according to the invention.
Figure 2:
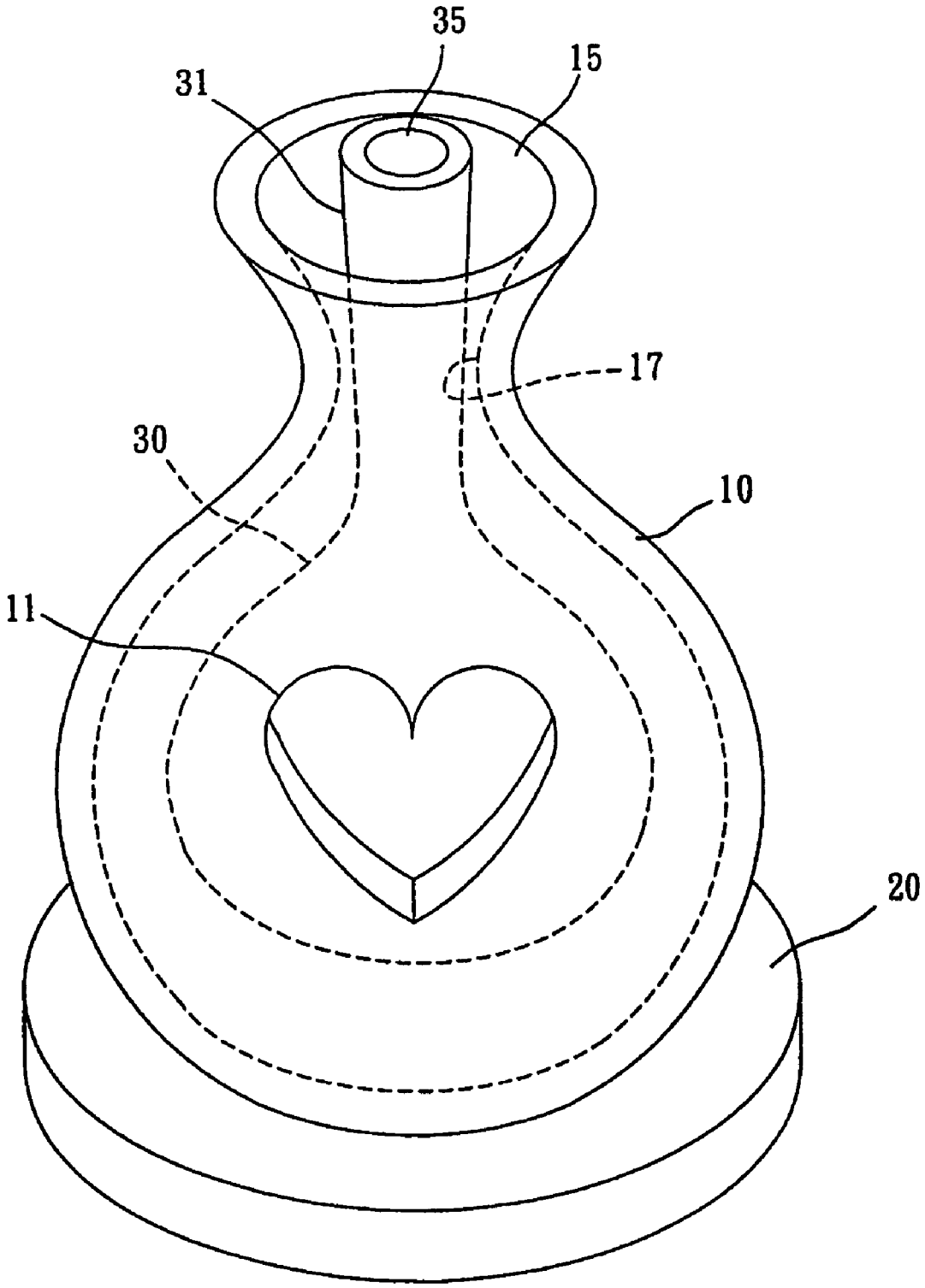
FIG. 2 is a perspective view of the assembled vase.
Figure 3:
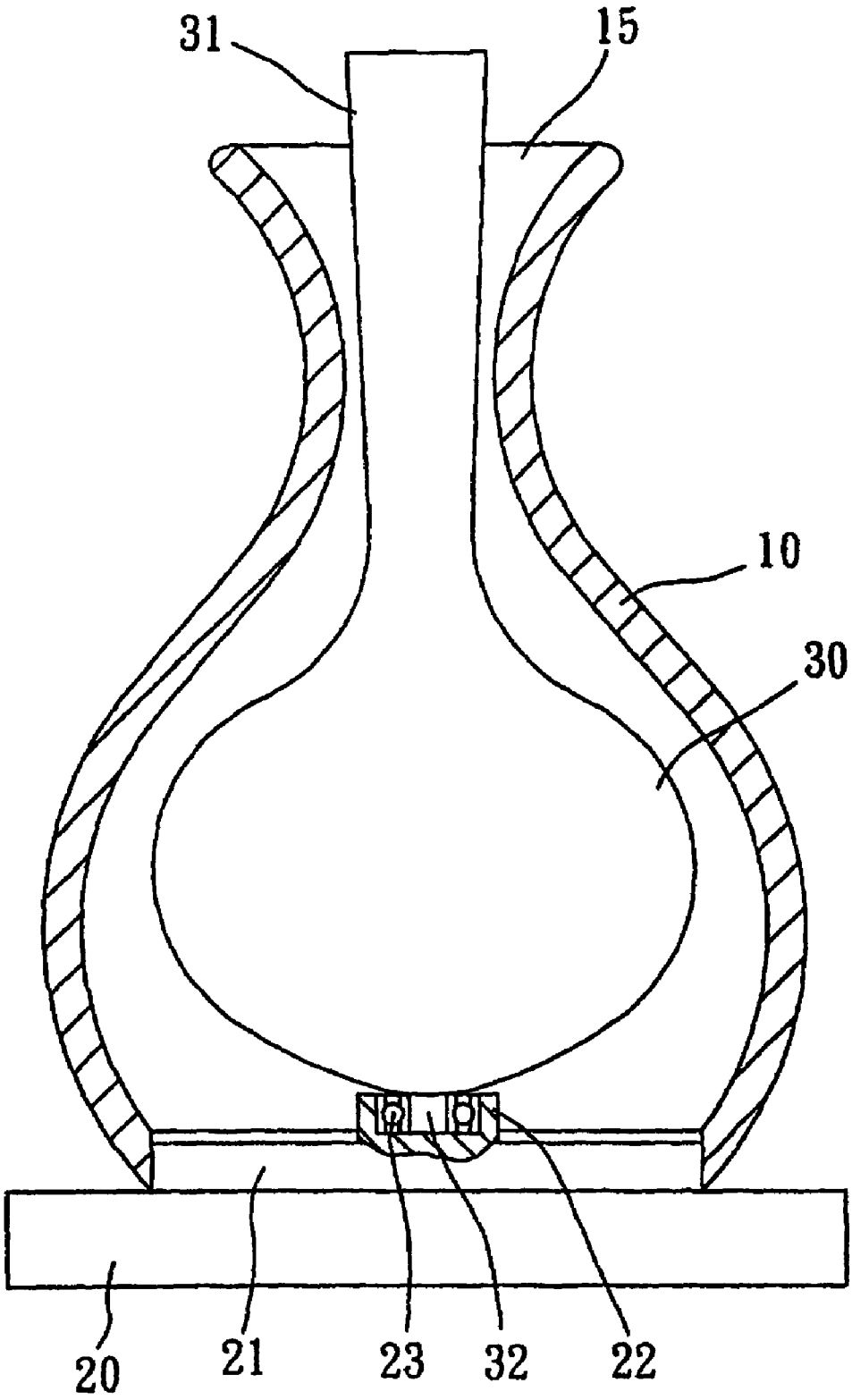
FIG. 3 is a sectional view of the vase of FIG. 2.

Referring to FIGS. 1 to 5, a vase in accordance with a first preferred embodiment of the invention comprises the following components as discussed in detail below.

An outer shell 10 comprises an open top end 15, an open bottom end 16, a neck 17 interconnecting a smaller upper portion and a larger lower portion, and a heart-shaped opening 11 on the outer surface. Two or more openings 11 can be formed on the outer surface of the outer shell 10 in other embodiments.

The outer shell 10 can be transparent or opaque. Preferably, the outer shell 10 is made of jade, ceramic, glass, porcelain, stone, metal, plastic, timber, bamboo, or the like.

An inner container 30 comprises an upper upright 31, an open top end 35 on the mouth of the upright 31, a closed bottom end (not numbered), a shaft 32 projecting downward from the center of the underside. Preferably, a first pattern 33A is formed on a first portion of the outer surface of the inner container 30 and a second pattern 33B different from the first pattern 33A is formed on a second, remaining portion of the outer surface thereof.

The inner container 30 can be transparent or opaque. Preferably, the outer shell 10 is made of jade, ceramic, glass, porcelain, stone, metal, plastic, timber, bamboo, or the like.

A circular base 20 comprises a smaller flat, circular member 21 projecting out of the top, an annular flange 22 on the top of the circular member 21, and an annular bearing 23.

The bearing 23 is fastened in the flange 22. The height of the shaft 32 is substantially the same as that of the flange 22. Hence, the surrounding area of the shaft 32 is seated upon the bearing 23 when the shaft 32 is rotatably disposed in the bearing 23. The bottom end 16 is sufficiently large to allow the inner container 30 to insert into the outer shell 10 until the upright 31 slightly projects out of the top end 15. Also, the bottom end 16 is sized to put onto the peripheral surface of the circular member 21. The assembly of the vase is thus finished.

Figure 4:
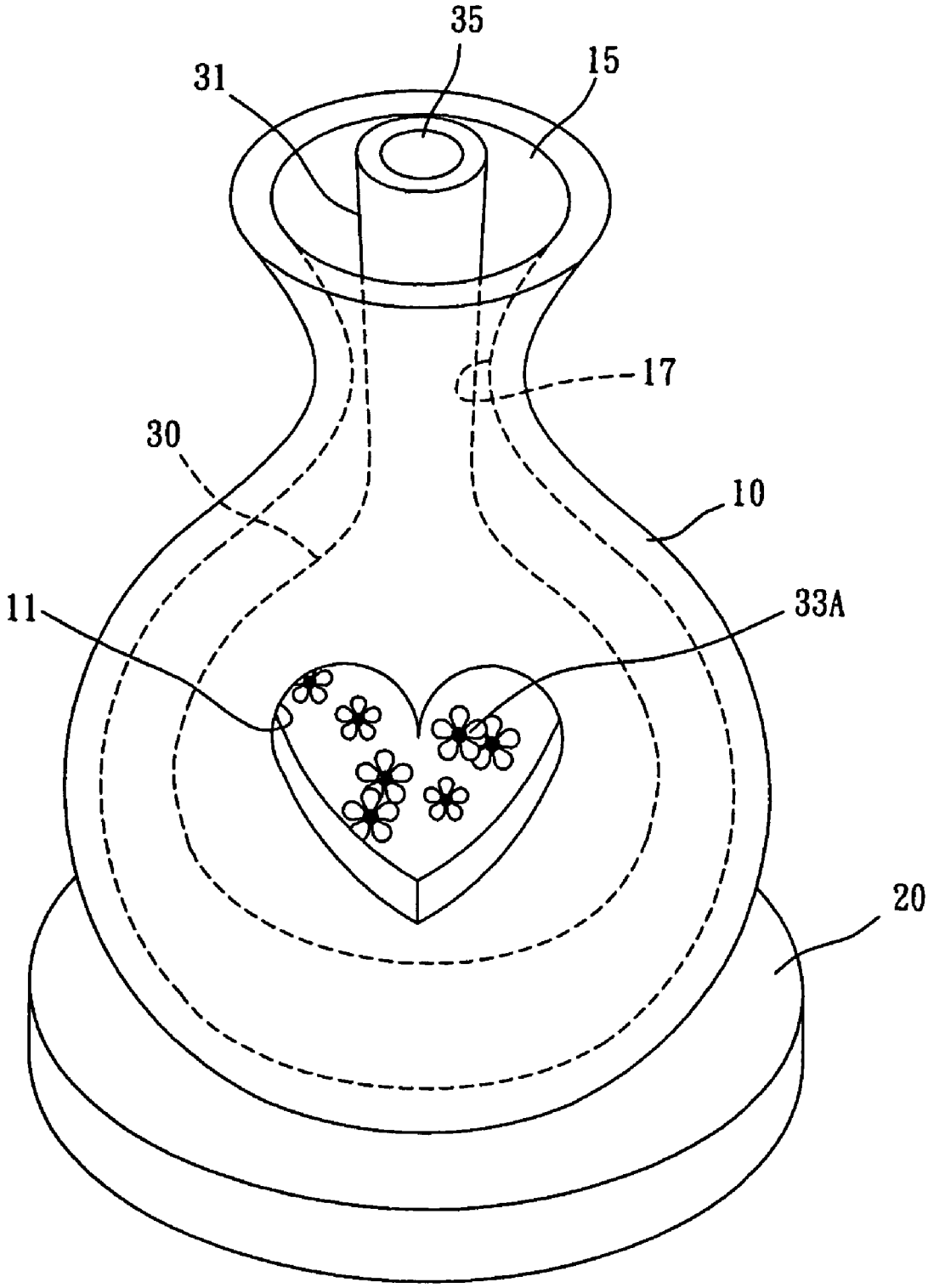
FIG. 4 is a view similar to FIG. 2 where another configuration of the inner container with a first pattern is shown prior to rotation.
Figure 5:
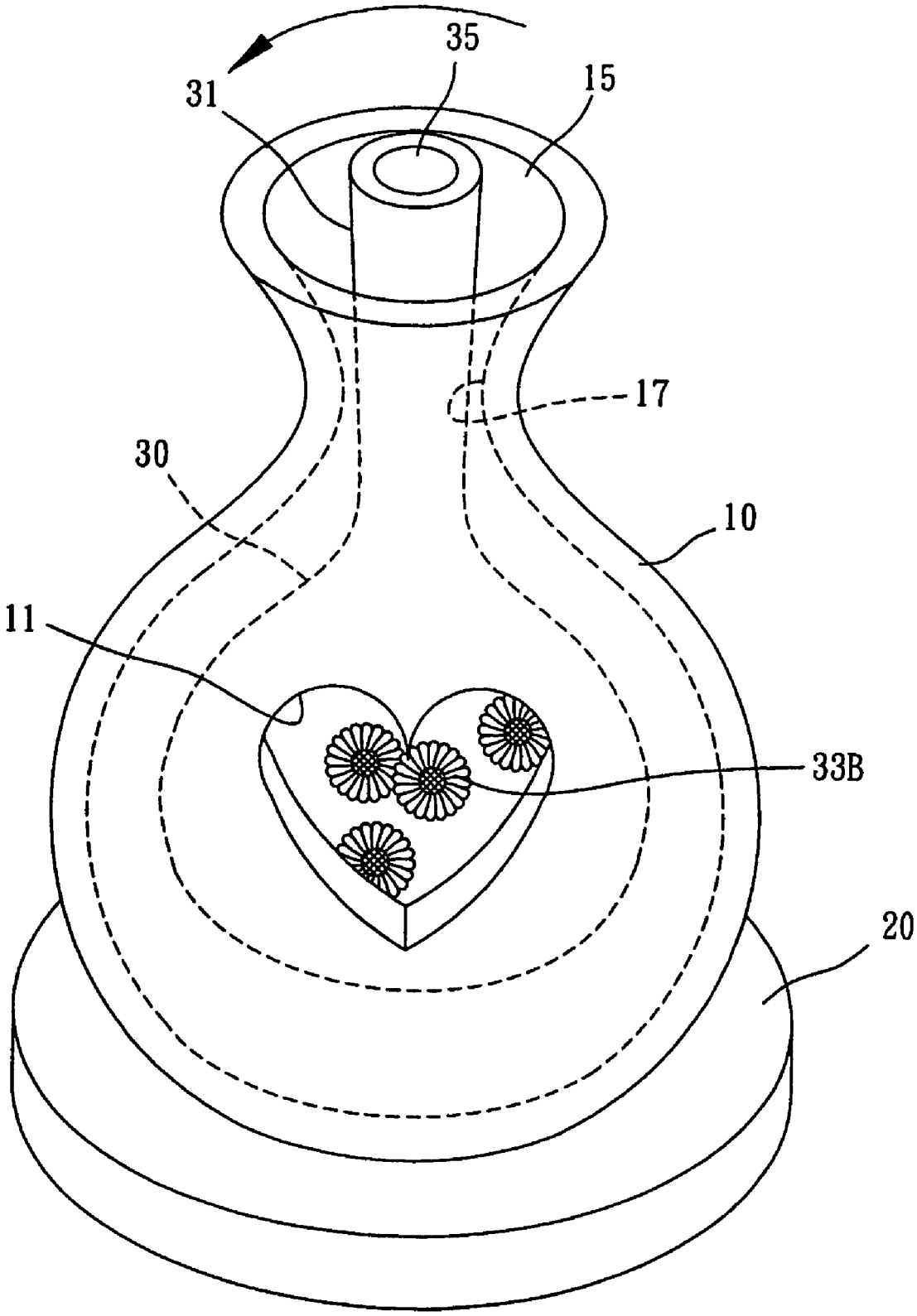
FIG. 5 is a view similar to FIG. 4 where the vase is rotating with a second pattern of the inner container being shown.

As shown in FIGS. 4 and 5 specifically, a person may hold and rotate the projecting top of the upright 31 as indicated by arrow. Hence, the shaft 32 rotates in the bearing 23 and thus the inner container 30 rotates about the outer shell 10. The person may, for example, see the first pattern 33A disappeared (see FIG. 4) and the second pattern 33B appeared (see FIG. 5) in turn through the opening 11. This is more amusable than the conventional stationary vases.

Figure 6:
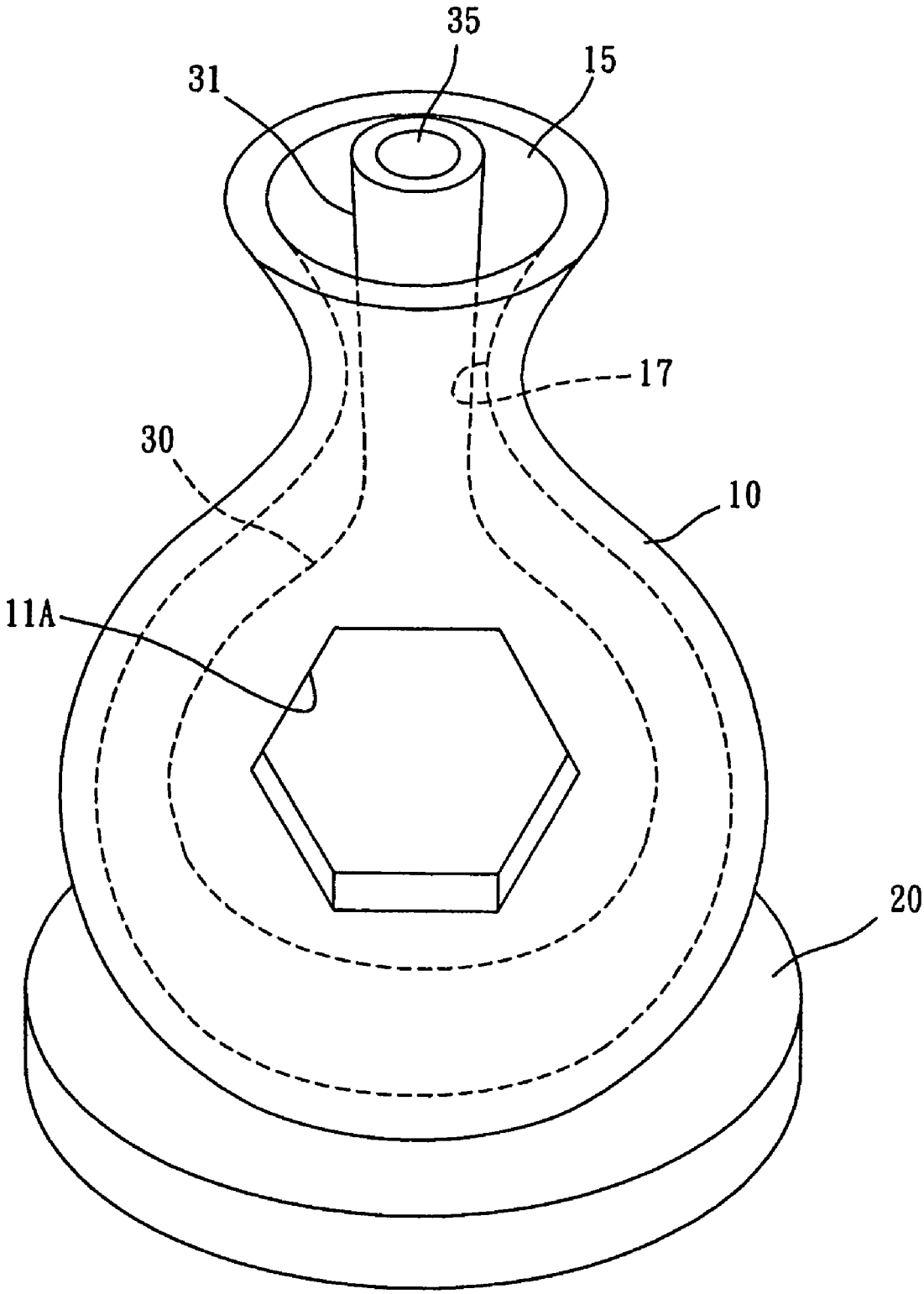
FIG. 6 is a perspective view of a second preferred embodiment of vase according to the invention.

Referring to FIG. 6, a vase in accordance with a second preferred embodiment of the invention is shown. The characteristic of the second preferred embodiment is detailed below. The opening 11A is hexagonal.

Figure 7:
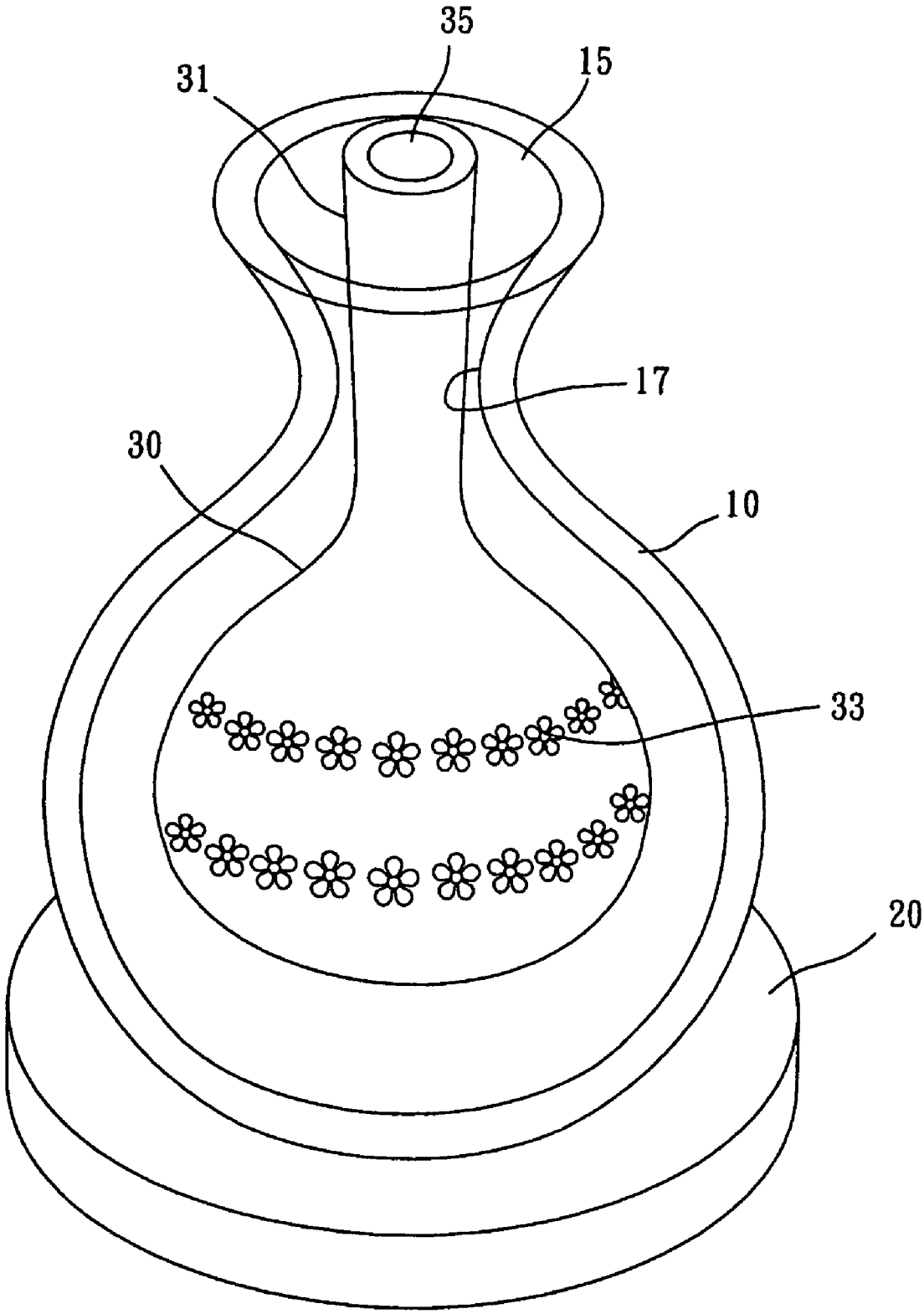
FIG. 7 is a perspective view of a third preferred embodiment of vase according to the invention.

Referring to FIG. 7, a vase in accordance with a third preferred embodiment of the invention is shown. The characteristic of the third preferred embodiment is detailed below. The outer shell 10 is made of a transparent material (e.g., glass, porcelain, or plastic) so that a person may directly see the inner container 30 in the outer shell 10.

While the invention herein disclosed has been described by means of specific embodiments, numerous modifications and variations could be made thereto by those skilled in the art without departing from the scope and spirit of the invention set forth in the claims.

What is claimed is:

1. A vase comprising:

an outer shell comprising open top and bottom ends and at least one opening on the surface;

a base comprising a projecting member on the top with the bottom end of the outer shell being securely put thereon, an annular flange on the top of the projecting member, and an annular bearing releasably fastened in the flange; and an inner container disposed in the outer shell and comprising an upper member projecting out of the top end of the outer shell, a central shaft projecting downward from an underside to be rotatably disposed in the bearing, and at least one pattern on an outer surface, wherein the inner container rotates within the outer shell.

2. The vase of claim 1, wherein the at least one opening is one opening.

3. The vase of claim 1, wherein the at least one pattern is two patterns.

4. The vase of claim 1, wherein the outer shell is transparent.

5. The vase of claim 1, wherein the outer shell is opaque.

6. The vase of claim 1, wherein the outer shell is formed of jade, ceramic, glass, porcelain, stone, metal, plastic, timber, or bamboo.

7. The vase of claim 1, wherein the inner container is formed of jade, ceramic, glass, porcelain, stone, metal, plastic, timber, or bamboo.

8. A vase comprising:

a transparent outer shell comprising open top and bottom ends;

a base comprising a projecting member on the top with the bottom end of the outer shell being securely put thereon, an annular flange on the top of the projecting member, and an annular bearing releasably fastened in the flange; and an inner container disposed in the outer shell and comprising an upper member projecting out of the top end of the outer shell, a central shaft projecting downward from an underside to be rotatably disposed in the bearing, and at least one pattern on an outer surface, wherein the inner container rotates within the outer shell.

9. The vase of claim 8, wherein the at least one pattern is one pattern.

10. The vase of claim 8, wherein the at least one pattern is two patterns.

11. The vase of claim 8, wherein the outer shell is formed of glass, porcelain, or plastic.

12. The vase of claim 8, wherein the inner container is formed of jade, ceramic, glass, porcelain, stone, metal, plastic, timber, or bamboo.

* * * * *